US006275120B1

(12) United States Patent
Vaninetti et al.

(10) Patent No.: US 6,275,120 B1
(45) Date of Patent: Aug. 14, 2001

(54) MICROSTRIP PHASE SHIFTER HAVING PHASE SHIFT FILTER DEVICE

(75) Inventors: Roy Vaninetti, Palm Bay; Gregory Marquardt, West Melbourne; Christopher Gregorean, Palm Bay, all of FL (US)

(73) Assignee: Harris Corporation, Melbourne, FL (US)

( * ) Notice: Subject to any disclaimer, the term of this patent is extended or adjusted under 35 U.S.C. 154(b) by 0 days.

(21) Appl. No.: 09/506,518

(22) Filed: Feb. 17, 2000

Related U.S. Application Data

(63) Continuation of application No. 09/057,672, filed on Apr. 9, 1998, now Pat. No. 6,043,722.

(51) Int. Cl.[7] ..... H01P 1/18
(52) U.S. Cl. ..... 333/161; 333/164
(58) Field of Search ..... 333/161, 164

(56) References Cited

U.S. PATENT DOCUMENTS

| | | | | |
|---|---|---|---|---|
| 3,295,138 | | 12/1966 | Nelson | 333/164 X |
| 3,568,105 | | 3/1971 | Felsenheld | 333/164 |
| 4,105,959 | | 8/1978 | Stachejko | 333/164 |
| 4,160,220 | | 7/1979 | Stachejko | 333/161 |
| 4,205,282 | | 5/1980 | Gipprich | 333/161 |
| 4,218,664 | | 8/1980 | Assal et al. | 333/156 |
| 4,238,745 | * | 12/1980 | Schwarzmann | 333/161 X |
| 4,652,883 | | 3/1987 | Andricos | 342/372 |
| 4,725,792 | | 2/1988 | Lampe, Jr. | 333/26 |
| 4,978,933 | | 12/1990 | Marconi | 333/117 |
| 5,451,905 | | 9/1995 | Gamand et al. | 330/286 |
| 5,489,880 | | 2/1996 | Swarup | 333/128 |
| 5,684,440 | | 11/1997 | Yabuki et al. | 333/204 |
| 5,703,020 | | 12/1997 | Das | 505/210 |
| 6,043,722 | * | 3/2000 | Vaninetti et al. | 333/161 X |
| 6,091,311 | * | 7/2000 | Waters | 333/161 |

FOREIGN PATENT DOCUMENTS

| | | | | |
|---|---|---|---|---|
| 123202 | * | 5/1988 | (JP) | 333/161 |

* cited by examiner

*Primary Examiner*—Benny Lee
(74) *Attorney, Agent, or Firm*—Allen, Dyer, Doppelt, MIlbrath & Gilchrist, P.A.

(57) ABSTRACT

A broad band phase shifter of the present invention can be used in a microstrip conductor and includes a power divider disposed along a microstrip conductor. The power divider has first and second outputs. A reference transmission line is disposed on the microstrip conductor and connected to the first output of the power divider. A phase shift filter device is disposed on the microstrip conductor and connected to the second output of the power divider. The phase shift filter device comprises a 180 degree phase shift coupled line structure formed of a first substantially linear 90 degree phase shift parallel line section, and a second substantially linear 90 degree phase shift parallel line section coupled to the first parallel. line section. The first and second 90 degree phase shift parallel line sections have parallel lines that are spaced about five mils apart. The first and second 90 degree phase shift parallel line sections also have parallel lines that are offset to each other.

3 Claims, 9 Drawing Sheets

MICROSTRIP PHASE SHIFTER HAVING PHASE SHIFT FILTER DEVICE

The present application is a continuation of U.S. patent application Ser. No. 09/057,672 filed Apr. 9, 1998, issued as U.S. Pat. No. 6,043,722 on Mar. 28, 2000.

FIELD OF THE INVENTION

This patent application relates to the field of phase shifters, and more particularly, to phase shifters that use microstrip conductors.

Background of the Invention

In a phased array antenna system, the overall. antenna system includes a plurality of different antenna elements that are individually steered to direct and/or receive a beam in a selected direction. By using a phased array antenna system, it is possible to reduce the side lobes and, thus, minimize any power that is wasted in the antenna system.

With this type of system, the antenna bear is steered by adjusting the relative phase shift of each antenna element through individual phase shifters that are connected to each antenna element. The arrays are also typically sensitive to frequency. To overcome any sensitivity to frequencies, the phased array antenna system typically will use time delay steering where the signals propagated in each antenna element are time delayed to create a time coherence, and thus, steer the antenna beam into the predetermined direction.

Some prior art phased array antenna systems use a switched line phase shifter having more phase at higher frequencies than at lower frequencies. These type of phased array antenna systems require more bits of phase shift to achieve the same amount of phase at low and high frequencies. This also creates a limit to the amount of beam forming that can be accomplished at any one frequency for a given bandwidth. Other prior art switched delay line phase shifters are designed for different subbands, but require complex, expensive and large switching networks or diplexers. Others are complex and heavy, some even using lumped elements, requiring broad band attenuators that are expensive and leave a great signal loss, thus mandating increased Again requirements. Even others have used 0 to 180 degree hybrids, but only for narrow band applications.

One type of phased array antenna system uses time delay steering having a binary controlled and switched delay line. This system uses appropriately delayed signals in each antenna element channel and is disclosed in U.S. Pat. No. 3,295,138 to Nelson. Each switched delay line comprises a plurality of fixed time delays, which are combined to produce successive increments of delay in response to binary control signals.

It is also desirable to use a microstrip circuit to reduce the cost of implementing a phased array antenna system. Microstrip is less expensive than other known prior art construction techniques. An example of a microstrip phase shifter is disclosed in U.S. Pat. No. 3,568,105 to Felsenheid. In the '105 patent, a reflective system is used, but does not disclose a switched line phase shifter with any time delay. The '138 patent, on the other hand, does disclose a switched line phase shifter that switches between two line lengths. However, the structure disclosed in the '138 patent works primarily on one frequency and has a more exact differential phase, and is thus limited to a narrow band area. It would be advantageous if a switched delayed line phased array could be used with a wideband system in a low cost microstrip.

It is believed that some prior art phased array antenna systems provide some phase shifting using filters as a phase shift element, and provide phase performance in the 100 MHZ to 300 MHZ frequency range with reduced size, such as possibly found on microstrip. This type of phase shifter can be used as a phase shifter in either a switched or series digital configurations, and contains individual filters with controlled phase shift values. Typically, the phase shifters are placed in tandem, with progressively greater phase shift angles to provide phase angle selectivity. However, it is desirable to form a structure that can be used with a wide range of frequencies, such as broad band in one or two GHz, and positioned on a microstrip conductor.

SUMMARY OF THE INVENTION

It is therefore an object of the present invention to provide a phase shifter used on a microstrip conductor that allows a broad band phase shift in the Gliz range, which can be readily manufactured at little cost with relative simplicity.

It is still another object of the present invention to provide a phase shifter using a microstrip conductor that can include several phase shift devices having progressively greater phase shift angles to provide phase angle selectivity in fie GHz range.

The present invention is advantageous because it allows the construction of a phase shifter a microstrip conductor and which accounts for broad band phase shift hybrid networks into a microstrip circuit without any complicated lumped element circuits. The phase shifter can also be combined to form a three-bit phase shifter that allows a beam to be minored around. The microstrip structure with the phase shift filter device of the present invention is also readily manufactured at low cost.

In accordance with present invention, a phase shifter includes a microstrip conductor and a substantially "U" shaped reference transmission line disposed as a microstrip conductor. This reference transmission line includes a base line and two legs extending from the base line.

A phase shift filter device is disposed as a microstrip conductor adjacent the reference transmission line. This phase shift filter device includes a phased base transmission line lying substantially parallel to the base line and adjacent to two legs of the reference transmission line. A substantially "U" shaped phased transmission line is connected to the phased base transmission line and forms an open area bounded by the phased base transmission line and the "U" shaped phased transmission line. The "U" shaped phased transmission line has a width less than a width of the reference transmission line.

In one aspect of the present invention, the phase shift filter device is formed as a 90° phase shift filter device. The radial stub is disposed as a microstrip conductor and bounded by the phased base transmission line and "U" shaped phased transmission line. The radial stub is connected to the "U" shaped phased transmission line.

BRIEF DESCRIPTION OF THE DRAWINGS

Other objects, features and advantages of the present invention will become apparent from the detailed description of the invention which follows, when considered in light of the accompanying drawings in which.

DETAILED DESCRIPTION OF THE PREFERRED EMBODIMENTS

The present invention will now be describe more fully hereinafter with reference to tile accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout the different drawing figures and may not be described in detail for all figures.

Figure 1:
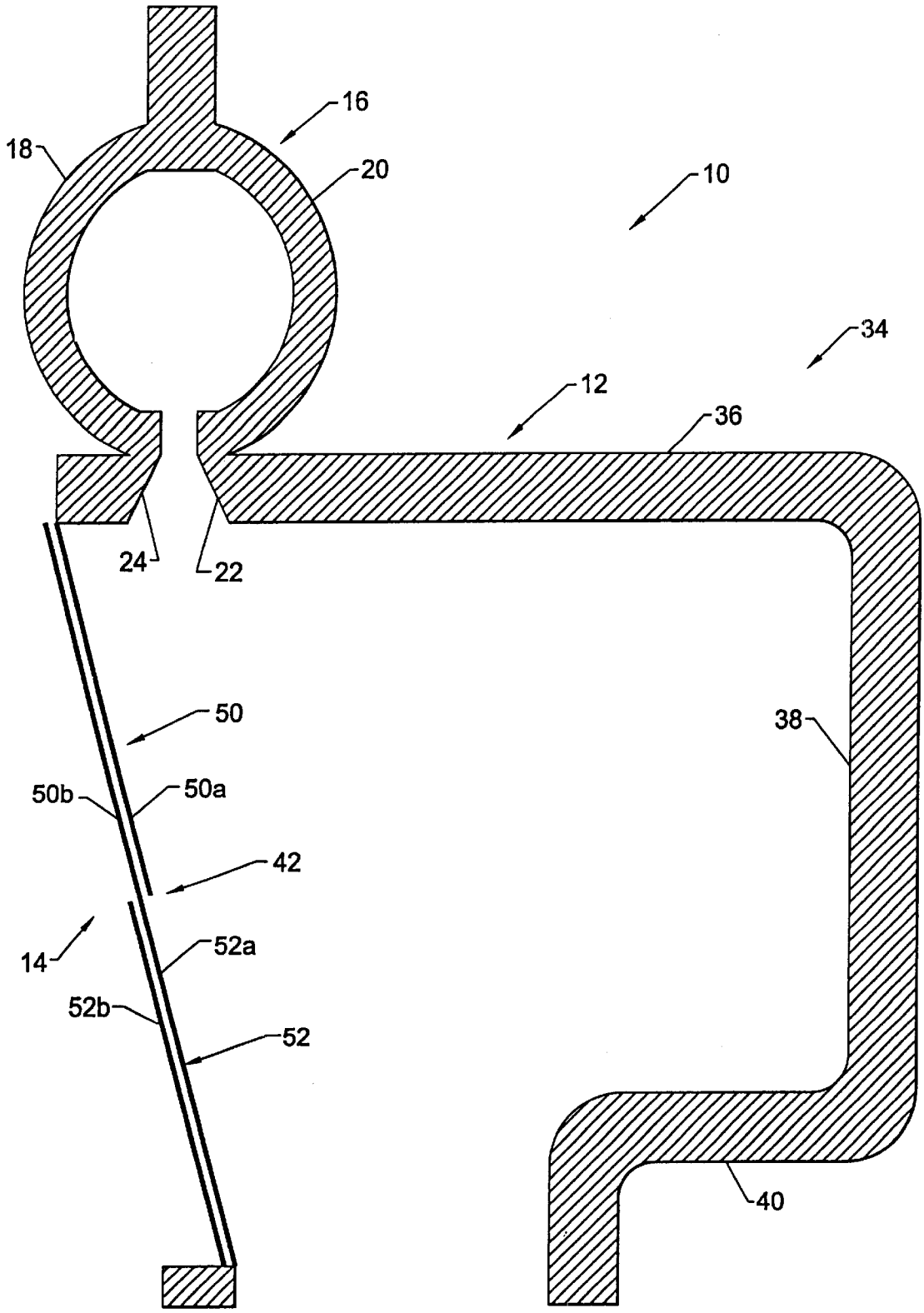
FIG. 1 shows a microstrip conductor formed as a 0/180 degree hybrid using a power divider and broad band phase shift device on one output of the power divider, and a reference transmission line functioning as a reference delay line connected to the other output of the power divider.

Referring now to FIG. 1, there is illustrated generally at 10 a phase shifter in accordance with the present invention that is included as part of a microstrip conductor 12 formed as a monolithic microwave integrated circuit. The microstrip conductor 12 can be formed by manufacturing techniques and materials known to those skilled in the art. Typically, the microstrip conductor, which could also be a strip line, is a transmission line formed typically on a monolithic microwave integrated circuit (MMIC). The microstrip conductor 12 functions similar to a distributed inductance in a microcircuit, but the transmission lines takes account of the associated capacitance, mutual coupling and discontinuities. Typically, the impedance of the microstrip circuit is determined by the ratio of a conductor width to any substrate thickness, dielectric constant of the substrate, and to a certain degree, the thickness of the conductor.

Figure 2:
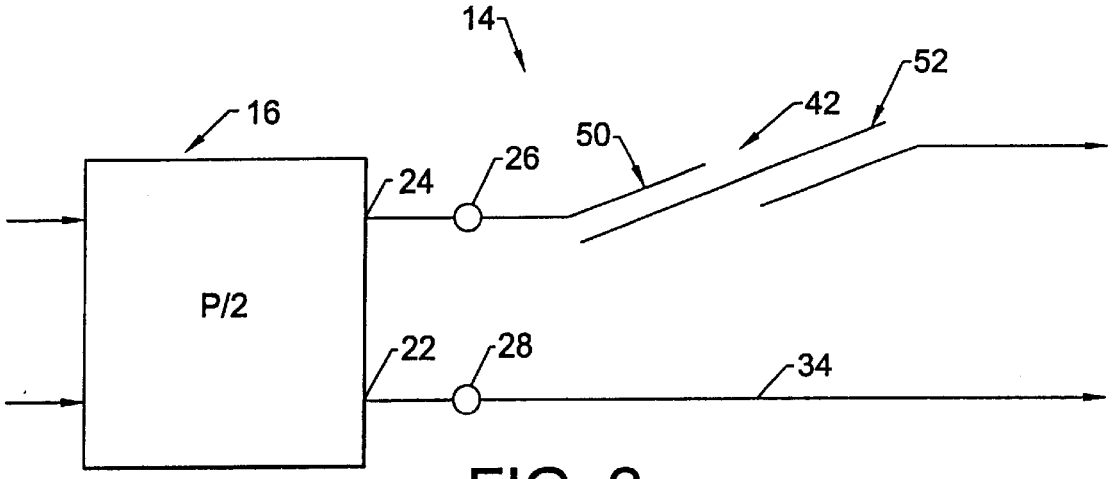
FIG. 2 is a schematic view of a coupled line section connected to a power divider to form a 0/180 degree hybrid.
Figure 3:
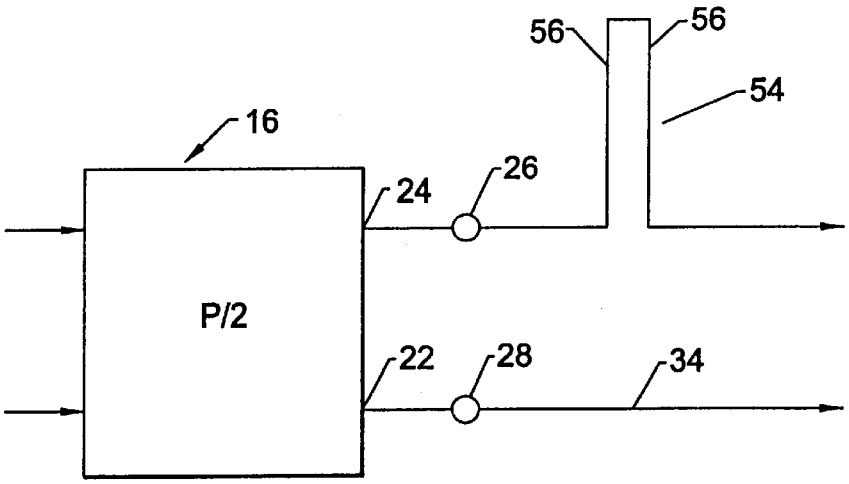
FIG. 3. (PRIOR ART)
FIG. 3 is a schematic view of a prior art Schiffman phase shift device connected to a power divider.

FIG. 1 illustrates a 0 to 180 degree hybrid formed as a coupled line structure 14 that allows a phase shift of 180 degrees as used in the present invention. FIG. 2 illustrates a schematic diagram of the coupled line structure 14 that is connected into a power divider (P/2) 16 such as by dividing the power P in half as set forth by the block diagram of the power divider labeled (P/2). The phase shifter 10 shown in FIG. 1 is advantageous over the older prior art Schiffman phase shifters (FIG. 3), which sometimes were inefficient and difficult to manufacture for various circuits.

As shown in FIG. 1, the microstrip conductor 12 includes a power divider 16, which in the illustrated embodiment is a Wilkinson power divider. The power divider comprises a single transmission power line separated into two opposing quarter wavelength sections 18, 20 as known to those skilled in the art. First and second outputs 22, 24 are positioned adjacent to each other to allow connection of an isolation resistor.

A reference transmission line 34 acts as a reference delay transmission line and is disposed on the microstrip conductor 12 and connected to the first output 22 of the poser divider 16. Tie reference delay transmission line 34 forms a substantially "U" shaped transmission line having a first longer section or leg 36 that is connected to the first output 22 of the power divider 16, followed by a reference transmission line second section 38 that extends substantially perpendicular to the longer leg 36. It is then followed by a third shorter section or leg 40 extending in a similar direction of the first leg 36, but having a shorter length than the first leg 36.

A phase shift filter device 42 of the present invention is formed as a microstrip conductor 12 and is connected to the second output 24 of the power divider 16. The phase shift filter device 42 of the present invention comprises a 180 degree phase shift coupled line structure 14 formed of a first substantially linear 90 degree phase shift parallel line section 50, and a second substantially linear 90 degree phase shift parallel line section 52 coupled to the first parallel line section. The first and second 90 degree phase shift parallel line sections are substantially collinear to each other and extend at an angle from the second output of the power divider in a direction toward the reference transmission line 34.

Each of the first and second 90 degree phase shift parallel line sections 50, 52 have first and second parallel lines 50*a*, 50*b*, 52*a*, 52*b*, respectively that are spaced apart about five mils, and as illustrated. The second parallel line 50*b* on the first 90 degree phase shift line section 50 is coupled to the first parallel line 52*a* of the second 90 degree phase shift line section 52. Each line 50*a*, 50*b*, 52*a*, 52*b* is substantially less in width than the reference line 34. In fact, even the total width of lines 50*a*, 50*b* or 52*a*, 52*b* plus the five mil gap is less than the width of reference line 38.

Figure 4:
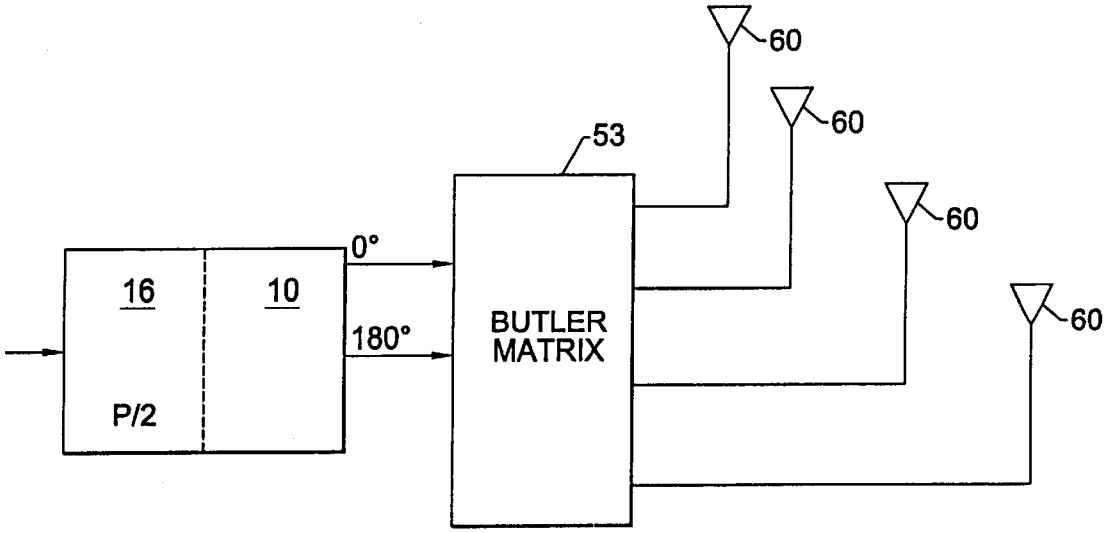
FIG. 4 is a schematic view of a phase shifter of the present invention connected to a Butler matrix for a multiple beam array.

The phase shifter of FIG. 1 is advantageous over other prior art phase shifters such as the prior art Schiffman phase shifter 54 (FIG. 3) using two parallel lines 56 connected to one output of a power divider 16. The phase shifter shown in FIG. 1 can be used to drive a Butler matrix 53 to form a multiple beam array for antenna 60, as shown in FIG. 4, where multiple networks can be used depending on system requirements. It is evident that a 0/180 degree phase shift occurs. The present invention is advantageous because it allows the broad band phase shift while allowing beam directivity.

Figure 5:
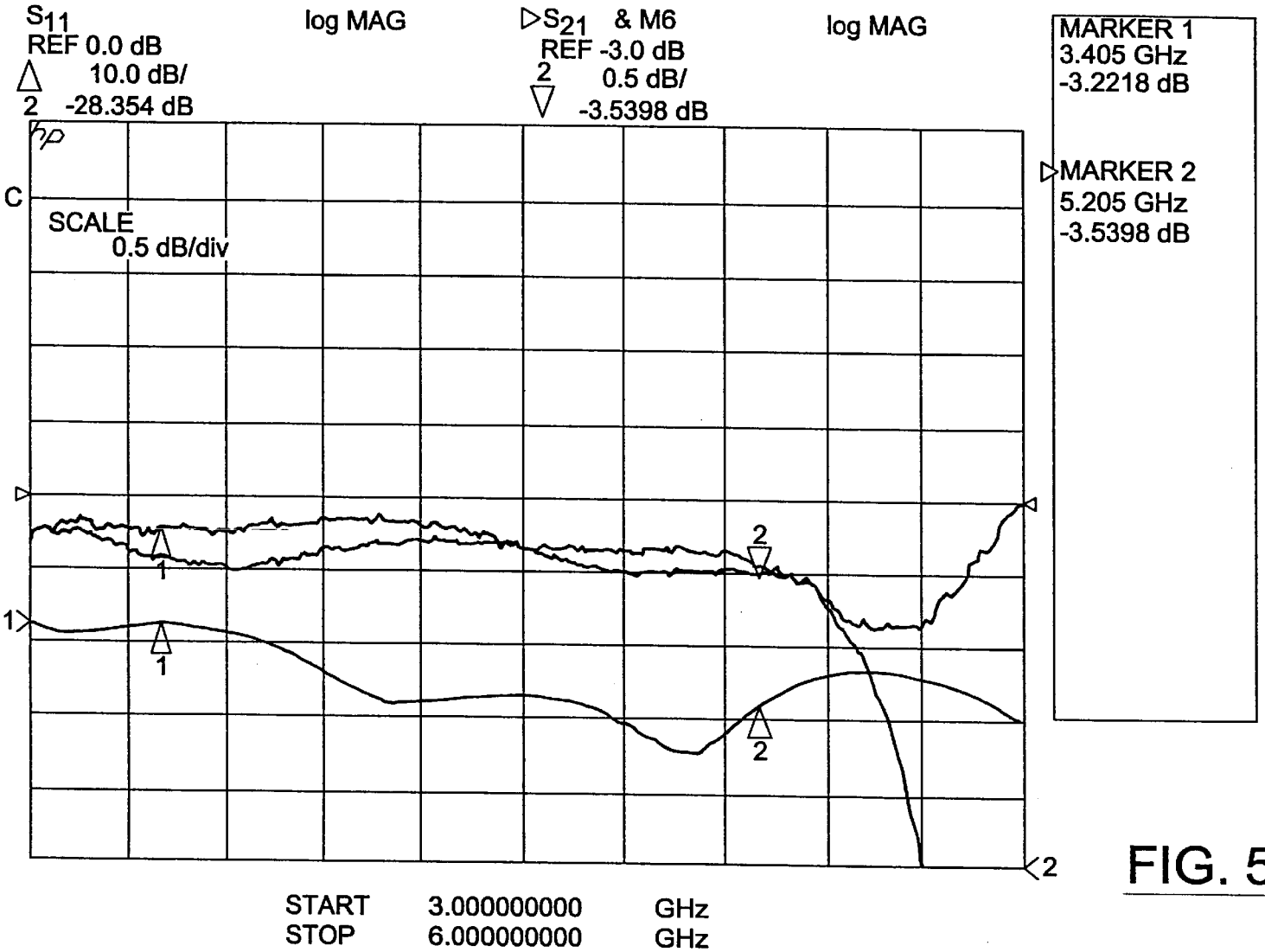
FIG. 5 is a graph showing measured data on the microstrip circuit shown in FIG. 1.
Figure 6:
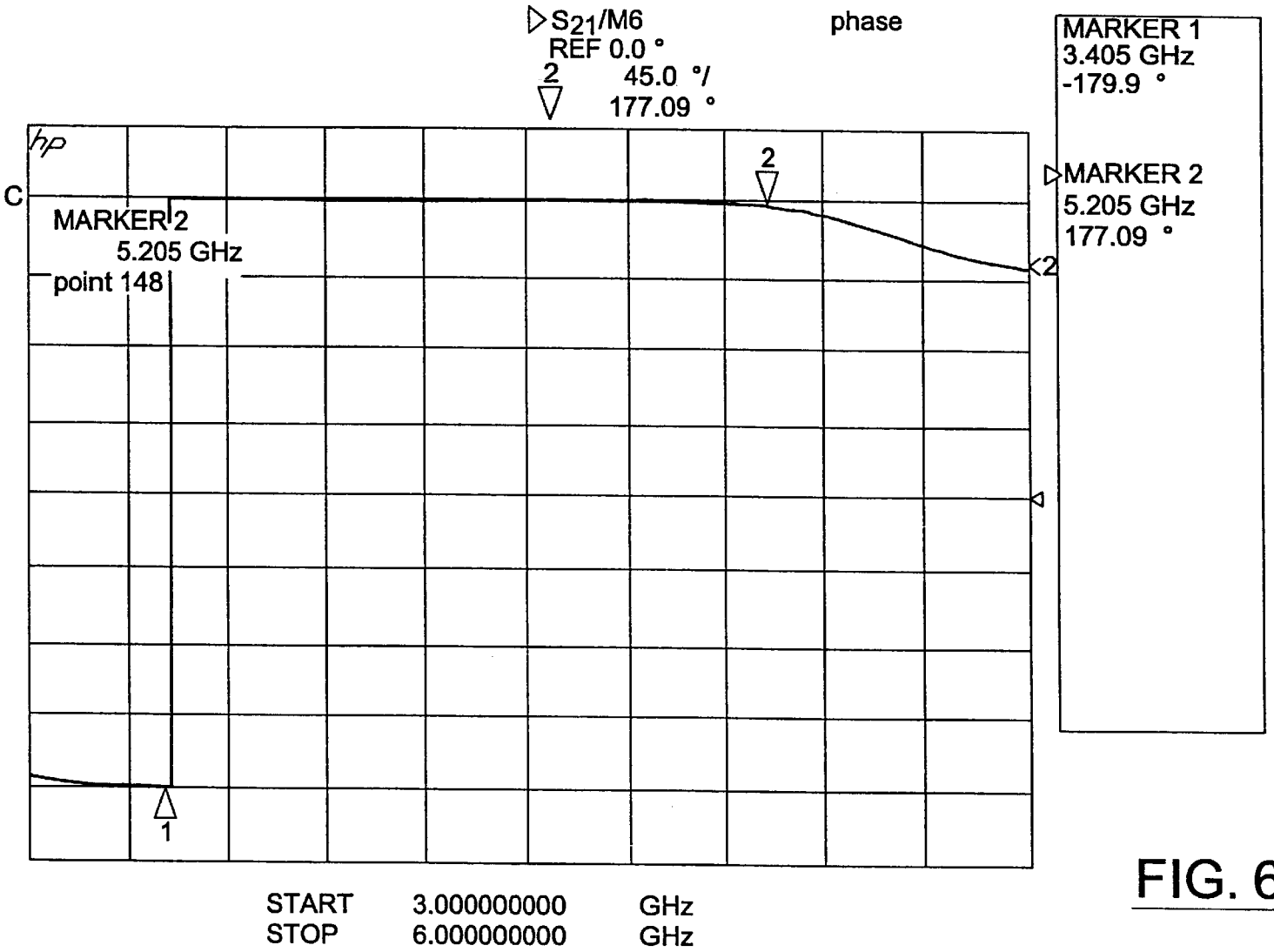
FIG. 6 is another graph showing measured data on the microstrip circuit shown in FIG. 1.

FIGS. 5 and 6 are graphs showing measured data on the microstrip conductor of FIG. 1.

FIG. 5 shows three traces. The bottom trace is S(1, 1), which is depicted on the upper left hand quadrant and effectively shows the return loss and how it is matched to the other two traces S(2, 1) and what is stored in memory M6. S(2, 1) and M6 are described in the other heading at the top of the graph and basically show the through path. Thus, FIG. 5 shows that the loss is virtually equally split between the two paths and illustrates the broad band nature of the invention. The left hand coordinates at 1, 1 are 10 db per division and the S(2, 1) are 0.5 db per division, thus giving more line changes. FIG. 6 shows the phase between the two through paths where the top description is S(2, 1) divided by M6, corresponding to the other path of the power divider. When one divides them, it is effectively subtracting the phase of the through path and shows that there is a 180° phase. It is shown as 45° per division. It is evident that the circuits shown in FIG. 1 allow a broad band phase shift and achieves excellent amplitude and phase balance over 3.4 to 5.2 GHz band.

Figure 7:
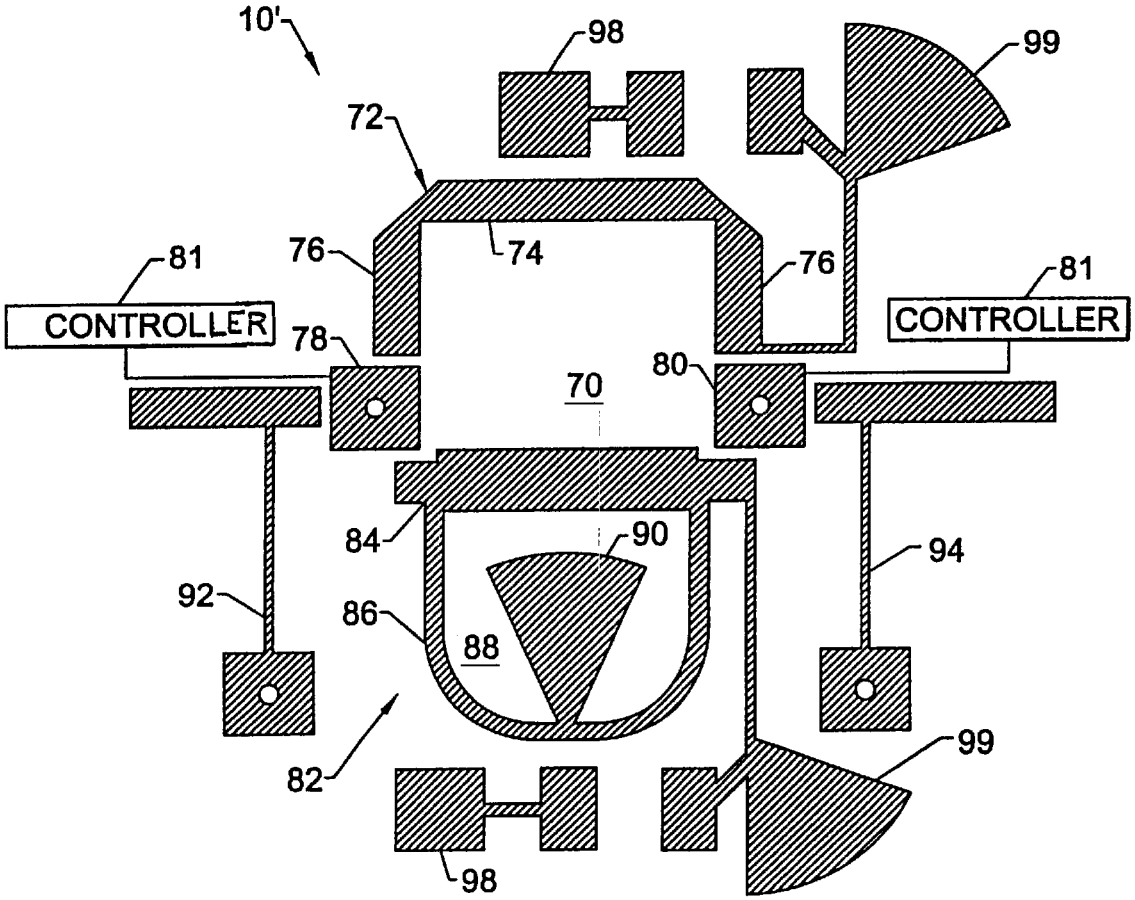
FIG. 7 is a schematic plan view of a microstrip circuit using a phase shifter having a reference transmission line and phase shift filter device formed as phased base transmission line and a substantially "U" shaped phased transmission line.

Referring now to FIG. 7, there is illustrated another embodiment of a phase shifter 10' in accordance with the present invention that allows a 90 degree phase shift. As illustrated, the phase shifter includes a microstrip conductor 70 having a substantially "U" shaped reference transmission line 72 formed on the microstrip conductor 70. Line 72 acts as a delay line. The reference transmission line 72 has a base line 74 with two legs 76 extending from the base line. Adjacent the two legs 76 and extending from the base line 74 are respective first and second switch points 78, 80 and connect zo controller 81.

A phase shift filter device 82 is formed as a microstrip conductor adjacent the reference transmission line 72 and the first and second switch points 78, 80. The phase shift filter device 82 comprises a phased base transmission line 84 positioned substantially parallel to the base line 74 and adjacent the two legs 76 of the reference transmission line 72.

A substantially "U" shaped phased transmission line 86 is connected to the phased base transmission line 84 and forms an open area 88 bounded by the phased base transmission line and the "U" shaped transmission line. The "U" shaped phased transmission line 86 has a width less than the reference transmission line 72. This difference in width helps establish the broad band capability of the device. As illustrated, a radial stub 90 is formed as a microstrip conductor 12 within the open area 88 bounded by the phased base transmission line 84 and the "U" shaped phased transmission line 86. The radial stub 90 is connected to the "U" shaped phased transmission line, which forms an RF short. The microstrip structure also includes biased circuits illustrated at 92 and 94. Other contact points 98 and circuit components 99 allow connection of the device to respective circuit connections. In operation, the first and second switch points 78, 80 are respectively operated to allow the 90 degree phase shift that is advantageous for use in the present invention.

Figure 8:
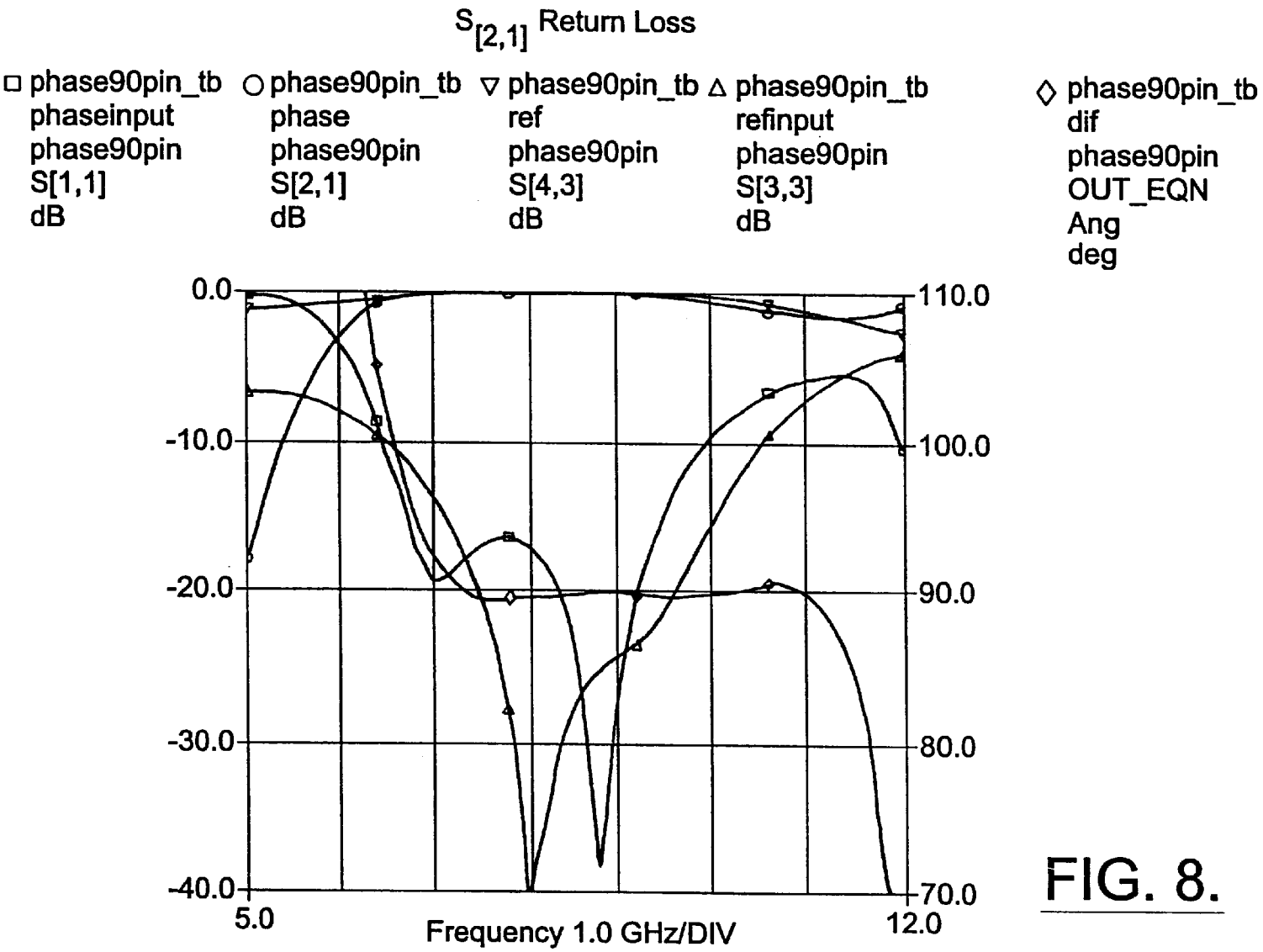
FIG. 8 is a graph showing the return loss and differential phase shift of the microstrip circuit of FIG. 7.

FIG. 8 is a graph illustrating a return Loss, S21, and the differential phase shift of the phase shifter of FIG. 7.

FIG. 8 describes the phase shifter, which is two switched paths and is a projected performance of the four traces (described by different squares, circles and triangles on the lines). S(1, 1) is the return loss, i.e., how well matched it is, and S(2, 1) is a through path. S(4, 3) is the through path of the other part of the phase shifter with the flag set on the line. S(3, 3) is the return loss of that path. The far right shows the output equation. S(2, 1) of one path is divided by the S(2, 1) of the other, which is depicted as S(4, 3). That gives a differential phase shift between the two as shown for 90°. The right hand axis shows a scale between 7 GHz to 11 GHz to get a 90° phase shift. The differential phase shift is derived by dividing S21 of the network under test by the S21 of the reference network and plotting the angle of the result. A predicted performance shows a flat 90 degree phase shift for an almost 3 GHz of bandwidth at a 9 GHz center frequency.

Figure 9:
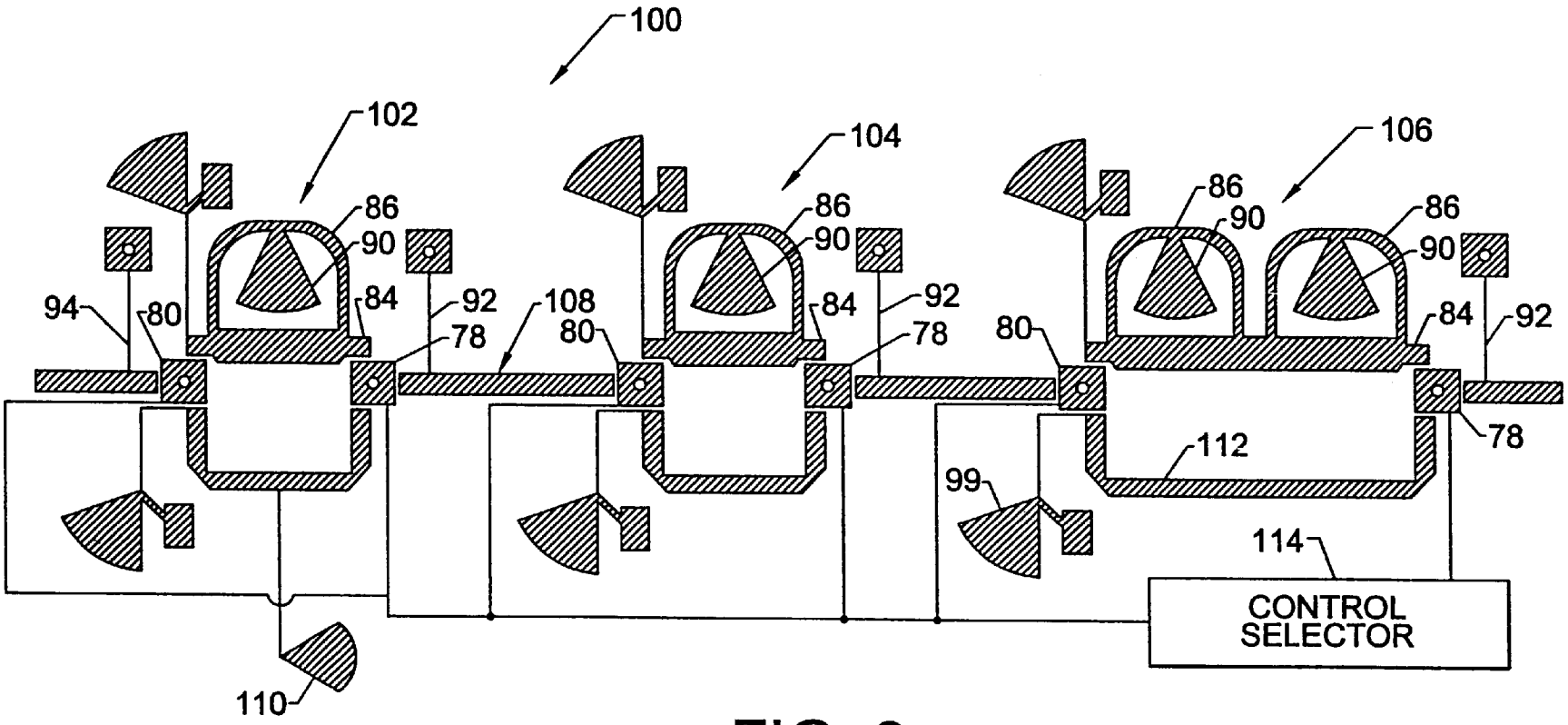
FIG. 9 is a microstrip circuit having a three-bit phase shifter of the present invention.

FIG. 9 shows a three-bit phase shifter 100 of the present invention that incorporates the basic structure of the phase shifter 10' shown in FIG. 7, but also includes a 45 degree phase shift filter device 102, a 90 degree phase shift filter device 104, and a 180 degree phase shift filter device 106. Unless otherwise noted, like reference numerals in FIG. 9 correspond to like elements as depicted iii the circuit of FIG. 7 and may not be described in detail for FIG. 9. These devices are formed on a microstrip conductor 108 that connects devices 102, 104 and 106 along one conductive path. The 45 degree phase shift filter device 102 is formed similar to that shown in FIG. 7, except it includes a radial stub 110 that is positioned offset from the reference transmission line to subtract 45 degrees from the 90 degrees.

The 90 degree phase shift filter device 104 is formed similar to that shown in FIG. 7 with no radial stub offset from the reference transmission line.

Figure 10:
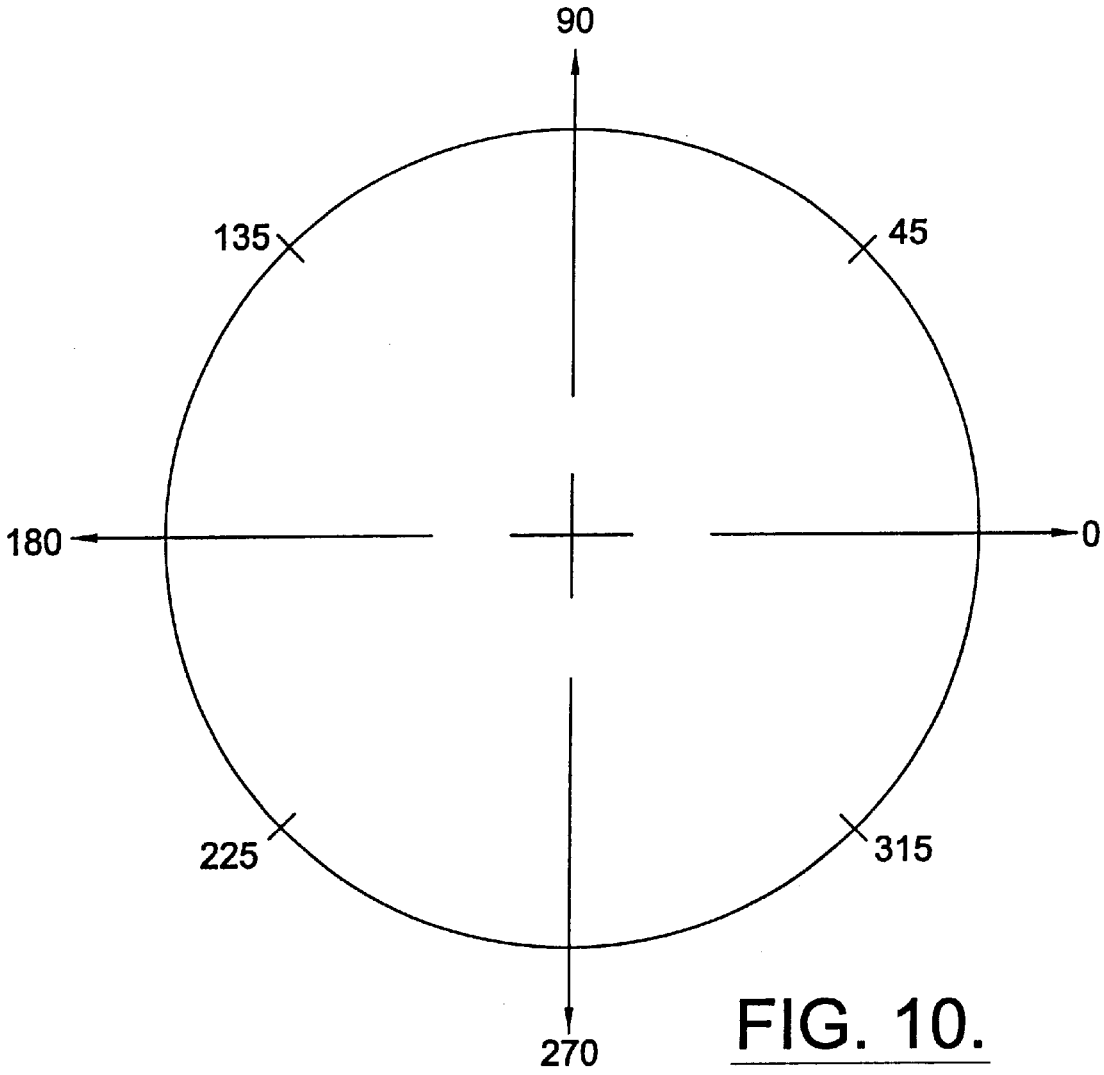
FIG. 10 is a graph illustrating the various beam angles that can be formed with the three-bit phase shifter illustrated in FIG. 9.

The 180 degree phase shift filter device comprises an enlarged substantially "U" shaped reference transmission line 112 and two substantially "U" shaped phased transmission lines 86 having a width less than the reference transmission line 112. Thus, the 180 degree phase shift filter device is basically the incorporation of two 90 degree phase shift filter devices as shown in FIG. 7. Each of the phase shift filter devices are selected by an appropriate control selector 114 to provide the desired 45° section of phase as shown in FIG. 10.

For example, three bits are input to obtain a desired angle. The appropriate degree angle relative to the input bit value could be as follows:

100=45°
010=90°
110=135°
001=180°
101=235°
011=270°
111=315°

It is evident that the present invention now allows a phase shifter that can be incorporated on a microstrip conductor and allows not only for ease in manufacturing, but allows a very broad band phase balance over an extended GHz band and excellent amplitude. Tile 0 to 180 degree hybrid using the coupled line structure is inexpensive and can be readily manufactured by semiconductor and antenna transmission line techniques known to those skilled in the art.

Many modifications and other embodiments of the invention will come to the mind of one skilled in the art having the benefit of the teachings presented in the foregoing descriptions and the associated drawings. Therefore, it is to be understood that tile invention is not to be limited to the specific embodiments disclosed, and that the modifications and embodiments are intended to be included within the scope of the dependent claims.

That which is claimed is:

1. A three bit phase shifter comprising:

a 45 degree phase shift filter device disposed as a first microstrip structure, said 45 degree phase shift filter device comprising a 90 degree phase shift filter device having a substantially "U" shaped first reference transmission line and a substantially "U" shaped first phased transmission line having a radial stub for subtracting 45 degrees, wherein said "U" shaped phased transmission line has a width less than the width of said first reference transmission line;

a 90 degree phase shift filter device disposed as a second microstrip structure and operatively connected to said 45 decree phase shift filter device, wherein said 90 degree phase shift filter device comprises a substantially "U" shaped second reference transmission line and a substantially "U" shaped second phased transmission line, wherein said "U" shaped phased transmission line has a width less than the width of said second reference transmission line;

a 180 degree phase shift filter device disposed as a third microstrip structure and operatively connected to said 90 degree phase shift filter device, wherein said 180 degree phase shift filter device comprises a substantially "U" shaped third reference transmission line and two substantially "U" shaped third phased transmission lines, wherein said "U" shaped phased transmission lines have a width less than said width of said third reference transmission line; and means for selecting said 45 degree, 90 degree and 180 degree phase shift filter devices to provide a beam in a desired direction.

2. A three-bit phase shifter according to claim 1, wherein said means for selecting said 45°, 90° and 180° phase shift filter devices to provide a beam in the desired direction comprises a control selector using three-bit inputs to obtain a desired angle.

3. A three-bit phase shifter according to claim 2, wherein said control selector can select angles based on 45 degree increments.

* * * * *

UNITED STATES PATENT AND TRADEMARK OFFICE

CERTIFICATE OF CORRECTION

PATENT NO. : 6,275,120 B1
DATED : August 14, 2001
INVENTOR(S) : Vaninetti et al.

It is certified that error appears in the above-identified patent and that said Letters Patent is hereby corrected as shown below:

Title page,
Item [63], Related U.S. Application Data, delete "Continuation of application No. 09/057,672, filed on April 9, 1998, now Pat. No. 6,043,722" substitute -- Divisional of application No. 09/057,672, filed on April 9, 1998, now Pat. No. 6,043,722 --

Column 1,
Lines 4-6, delete "The present application is a continuation of U.S. patent application Ser. No. 09/057,672 filed Apr. 9, 1998, issued as U.S. Pat. No. 6,043,722 on Mar. 28, 2000." substitute -- The present application is a divisional of U.S. patent application Ser. No. 09/057,672 filed Apr. 9, 1998, issued as U.S. Pat. No. 6,043, 722 on Mar. 28, 2000. --

Signed and Sealed this

Eleventh Day of December, 2001

*Attest:*

Nicholas P. Godici

*Attesting Officer*

NICHOLAS P. GODICI
*Acting Director of the United States Patent and Trademark Office*

UNITED STATES PATENT AND TRADEMARK OFFICE

CERTIFICATE OF CORRECTION

PATENT NO. : 6,275,120 B1
DATED : August 14, 2001
INVENTOR(S) : Vaninetti et al.

It is certified that error appears in the above-identified patent and that said Letters Patent is hereby corrected as shown below:

Column 1,
Line 42, delete “Again” substitute -- gain --

Column 2,
Line 18, delete “Gliz” susbtitute -- GHz --
Line 23, delete “fie” substitute -- the --
Line 27, insert the word -- using -- between the words “shifter” and “a”
Line 32, delete “minored” substitute -- moved --

Column 3,
Line 29, delete “describe” substitute -- described --
Line 30, delete “tile” substitute -- the --
Lines 38-39, delete the phrase: “the different drawing figures and may not be described in detail for all figures”

Column 4,
Line 11, delete “poser” substitute -- power --

Column 5,
Line 19, delete “zo” substitute -- to --

Column 6,
Line 7, delete “iii” substitute -- in --
Line 45, delete “Tile” substitute -- The --
Line 53, delete “tile” substitute -- the --

Column 7,
Line 3, delete “decree” substitute -- degree --

Signed and Sealed this

Eighteenth Day of June, 2002

*Attest:*

*Attesting Officer*

JAMES E. ROGAN
*Director of the United States Patent and Trademark Office*